US010524598B2

(12) United States Patent
Green

(10) Patent No.: US 10,524,598 B2
(45) Date of Patent: Jan. 7, 2020

(54) EASILY CLEANABLE DRINKING ASSEMBLY

(71) Applicant: Benny Green, Ramat Beit Shemesh (IL)

(72) Inventor: Benny Green, Ramat Beit Shemesh (IL)

( * ) Notice: Subject to any disclaimer, the term of this patent is extended or adjusted under 35 U.S.C. 154(b) by 313 days.

(21) Appl. No.: 15/145,592

(22) Filed: May 3, 2016

(65) Prior Publication Data

US 2017/0320643 A1 Nov. 9, 2017

(51) Int. Cl.
*A47G 19/22* (2006.01)

(52) U.S. Cl.
CPC ..... *A47G 19/2272* (2013.01)

(58) Field of Classification Search
CPC .. B65D 51/005; B65D 51/18; B65D 47/0857; B65D 43/16; B65D 43/0225; B65D 25/34; B65D 2251/009; B65D 2251/0087; B65D 2251/0028; B65D 2251/0025; B65D 2543/00046; B65D 2251/0081; A47G 19/2272
USPC ..... 220/254.3, 254.5, 737–739, 400, 403, 220/714, 717; 215/305, 387–389
See application file for complete search history.

(56) References Cited

U.S. PATENT DOCUMENTS 2,076,132 A 4/1937 Le Rose
2,394,135 A * 2/1946 Baar ..... B65D 41/0485 215/295
2,552,080 A 5/1951 Amberg
3,930,806 A 1/1976 Racz
6,197,438 B1 3/2001 Faulkner
7,093,340 B2 8/2006 Groll
2003/0062367 A1 4/2003 Robinson et al.
2005/0205577 A1 9/2005 Park
2009/0041909 A1 2/2009 Jeter, III
2011/0108551 A1 5/2011 Lee et al.
2011/0132908 A1* 6/2011 Meehan ..... A47G 19/2227 220/254.3
2011/0287193 A1* 11/2011 Creyghton ..... C23C 16/50 427/569
2014/0205804 A1 7/2014 Jones et al.
2014/0233344 A1* 8/2014 Aliberti ..... A47J 43/27 366/130

(Continued)

FOREIGN PATENT DOCUMENTS

WO WO0014298 A1 3/2000
WO WO0026100 A1 5/2000
WO WO2012108850 A1 8/2012

*Primary Examiner* — James N Smalley
(74) *Attorney, Agent, or Firm* — UCLA Patent Law Clinic

(57) ABSTRACT

An easily cleanable drinking assembly having a receptacle, a lid, and a coating with hydrophobic, oleophobic, and antimicrobial properties. The receptacle has an inner curved surface having a geometry with no edges, corners, or distinctly angled connections between sections, preventing any fluid or particles from remaining in these areas. The receptacle further has a wider opening and narrower end, allowing for ease of cleaning, so that a cleaning instrument can easily be inserted and easily reach all parts of the interior of the receptacle. Both the interior of the receptacle and the lid are coated with a coating with hydrophobic, oleophobic, and antimicrobial properties, repelling common fluids and particles, maintaining the cleanliness of the interior surfaces and improving the ease of cleaning.

14 Claims, 7 Drawing Sheets

(56) References Cited

U.S. PATENT DOCUMENTS

2014/0246429 A1 9/2014 Song et al.
2014/0349061 A1* 11/2014 Sikka ..... B29C 33/424
428/98

* cited by examiner

EASILY CLEANABLE DRINKING ASSEMBLY

FIELD OF THE TECHNOLOGY

The invention relates generally to the field of drinking assemblies, and more particularly to easily cleanable drinking assemblies, such as those found in CPC Class A45F (Traveling and Camp Equipment), Subclasses 3/16 (Water Bottles; Mess-tins; Cups) and 2200/0583 (Beverage Vessels).

DESCRIPTION OF PRIOR ART

A wide variety of drinking assemblies have been available for many years. Such products typically include a container body, such as a cup or bottle, and often include a lid to provide a spill-proof seal when properly fastened. These products come in a variety of materials, including various plastics and stainless steel.

Some products provide a mechanism for controlling the passage of fluid through the lid for drinking purposes. Some examples include valve mechanisms that seal the opening unless drinking suction is applied by the user, mechanical lever systems actuated by manual application of a force to a button or switch, and lids with reversibly openable sections, whether by lifting a tab, twisting a cover, or sliding back a movable section of the lid. Other products require removal of the lid entirely to drink from the container.

Each of these assemblies, however, possess a number of edges, grooves, and crevices where fluid tends to collect and remain, making it difficult to thoroughly clean the product as desired. As a result, the leftover particles contaminate whatever fluid the user intends to drink next, often ruining the flavor or providing a place where bacteria or fungus may lodge and grow. The leftover fluid can also result in unpleasant odors and microbial growth that can be detrimental to the health of the user. There is therefore a need for a drinking assembly that can be thoroughly cleaned in a simple manner, through conventional means and without need for special equipment or materials.

BRIEF SUMMARY

What is needed is an easily cleanable drinking assembly that can be thoroughly cleaned by conventional cleaning methods.

The drinking assembly includes geometrical features and the use of a specialized coating allows for thorough cleaning by conventional cleaning methods.

An easily cleanable drinking assembly according to a first aspect of the illustrated embodiments of the invention includes a receptacle with an inner surface having a curved geometry without edges, corners, or distinctly angled connections between sections. This includes, but is not limited to, inner surfaces that are completely rounded, spherical, and/or bulbous in nature. This also includes, but is not limited to, an inner surface created out of multiple rounded inner sections joined together by any number of rounded or smooth connection or transition sections.

An easily cleanable drinking assembly according to a second aspect of the illustrated embodiments of the invention similarly includes a lid with an interior curved surface without edges, corners, or distinctly angled connections or transitions between interior sections as well. Once again, this includes, but is not limited to, interior surfaces that are completely rounded, spherical, and/or bulbous in nature.

This also includes, but is not limited to, an interior surface created out of multiple rounded sections joined together by any number of rounded connection sections. Alternatively, the lid can be a more conventional lid with edges that are easily reachable with conventional cleaning tools.

An easily cleanable drinking assembly according to a third aspect of the illustrated embodiments of the invention includes an opening into the receptacle portion of the assembly, which allows for cleaning apparatus to be comfortably inserted and used inside the receptacle. The inner surface may be constructed to be broader at the opening and narrower at the base.

An easily cleanable drinking assembly according to a fourth aspect of the illustrated embodiments of the invention includes a coating with hydrophobic, oleophobic and antimicrobial properties. The coating may be applied to the entire inside of the assembly or may be selectively applied to any critical surface of the assembly, such as the inner surface of the receptacle or the interior surface of the lid.

It can now be summarized that the illustrated embodiments of the invention are directed to an easily cleanable drinking assembly including: a receptacle having an inner surface, a closed end and an open end, where the inner surface of the receptacle with a curved lower base without any edge; an attachable and detachable lid having an inner surface which is cured without any edge, where the inner surface of the drinking assembly is comprised of the inner surfaces of the receptacle and the lid, the inner surface of the drinking assembly being without any edge when the lid is attached to the receptacle; and a single coating that has hydrophobic, oleophobic and antimicrobial properties on the inner surface of the receptacle.

The single coating has hydrophobic, oleophobic and antimicrobial properties is also on the inner surface of the lid and may also be on the interior surface of the lid.

The receptacle has a diameter that decreases from the open end of the receptacle toward the closed end of the receptacle.

The receptacle has an exterior surface of the receptacle with at least one raised ridge.

The drinking assembly further includes a removable grip sleeve with at least one slot defined therethrough matching the at least one raised ridge on the exterior surface of the receptacle.

The inner surface of the receptacle defines a conical shape with a smooth rounded apex.

The illustrated embodiments can also be characterized as an easily cleanable drinking assembly including a receptacle having a closed end and an open end with an inner surface of the receptacle with a completely rounded lower base portion of the inner surface; a removable lid; and a hydrophobic, oleophibic and antimicrobial coating on the inner surface of the receptacle and an interior surface of the lid.

Still further the illustrated embodiments include an easily cleanable drinking assembly, comprising: a receptacle having a closed end, an open end, and an exterior surface, wherein the exterior surface has at least one raised ridge, where the receptacle has an inner surface, wherein the inner surface has a completely rounded lower base, and is coated with a single hydrophobic, oleophobic and antimicrobial coating; a removable lid, wherein an interior surface of the lid is completely rounded; and a second single hydrophobic, oleophobic and antimicrobial coating disposed on the inner surface of the receptacle and removable lid.

While the apparatus and method has been described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

Various exemplary embodiments of this disclosure will be described in detail, wherein like reference numerals refer to identical or similar components or steps, with reference to the following figures, wherein.

DETAILED DESCRIPTION OF THE PREFERRED EMBODIMENTS

Particular embodiments of the present invention will now be described in greater detail with reference to the figures.

Figure 1:
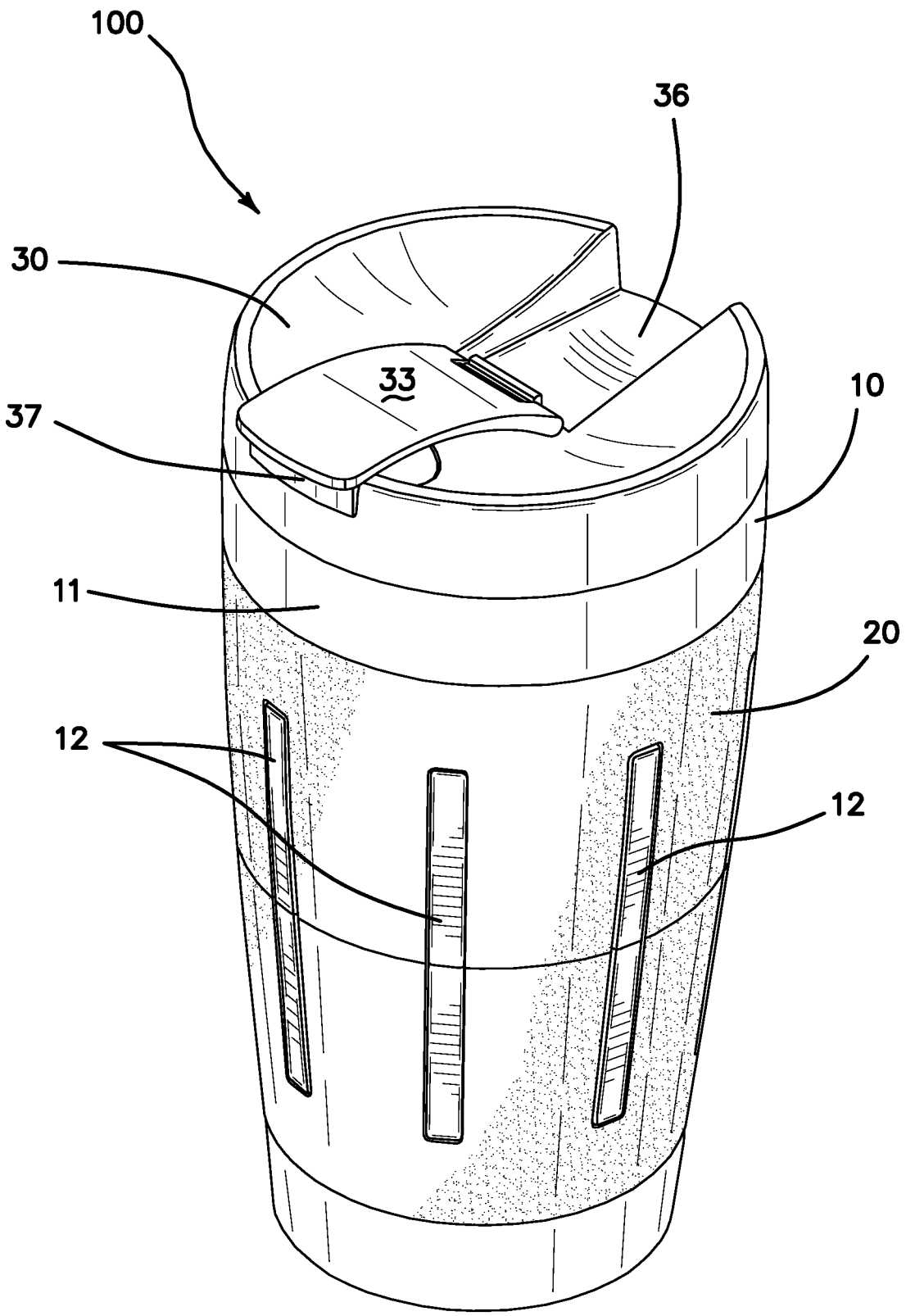
FIG. 1 illustrates an upper perspective view of an exemplary drinking assembly.

FIG. 1 illustrates an upper perspective view of an exemplary drinking assembly 100. The assembly 100 includes a receptacle 10 and a matching lid 30.

Figure 2:
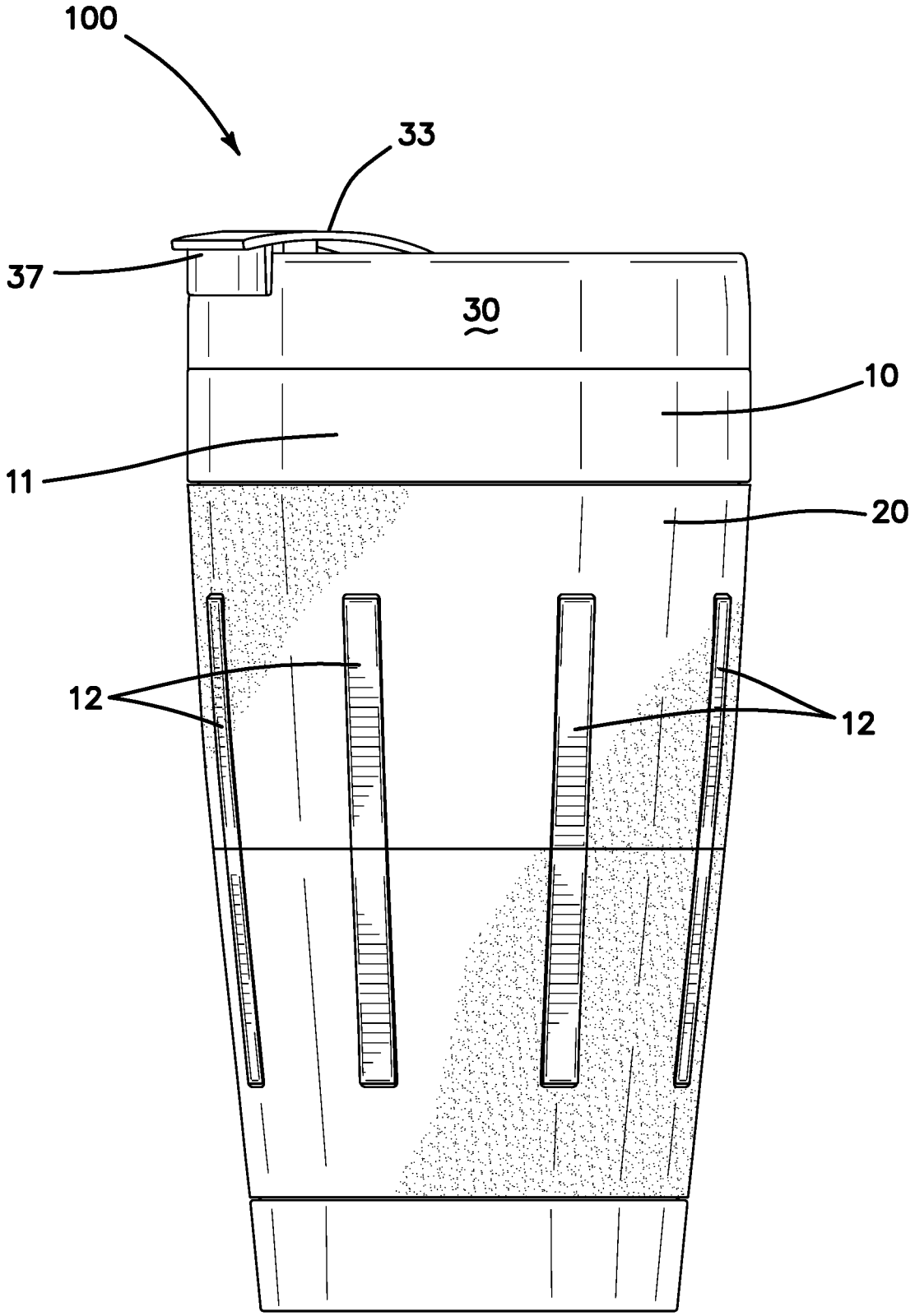
FIG. 2 depicts a side view of the easily cleanable drinking assembly of FIG. 1.
Figure 3:
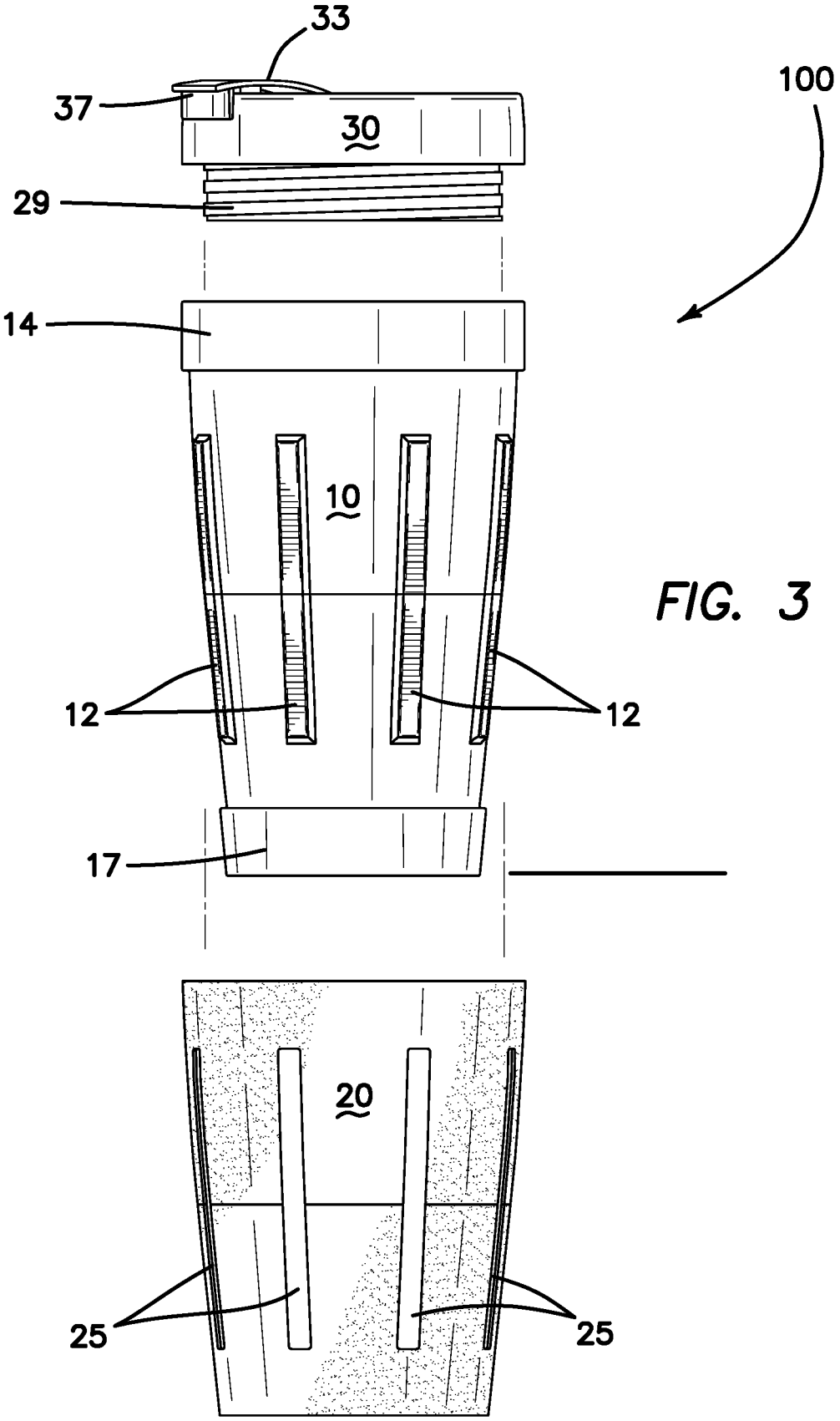
FIG. 3 shows an exploded side view of the drinking assembly of FIGS. 1 and 2 with the removable grip sleeve.

FIG. 2 depicts a side view of the assembly 100. According to this embodiment, the receptacle 10 has an outer surface 11 with a plurality of raised ridges 12. These raised ridges 12 allow a user to hold the receptacle 10 with a firm grip and in a stable manner. A removable grip sleeve 20 may also be used to increase the comfort and stability with which a user can hold the receptacle 10, as shown in FIG. 3. Receptacle is telescopically or axially disposed into sleeve 20 or equivalently sleeve 20 is concentrically disposable around the outside of receptacle 10. The removable grip sleeve 20 may also have a plurality of slots 25 matched to the number and location of the raised ridges 12. Ridges 12 are thus alignable with slots 25 in sleeve 20 and extend therethrough. Matching the slots 25 and the ridges 12 in this way allows the removable grip sleeve 20 to be held securely onto the receptacle 10 and prevent accidental removal. The sleeve 20 maybe be made of any grip-increasing material, including rubber, foam, non-slip PVC material, and vinyl.

Figure 4:
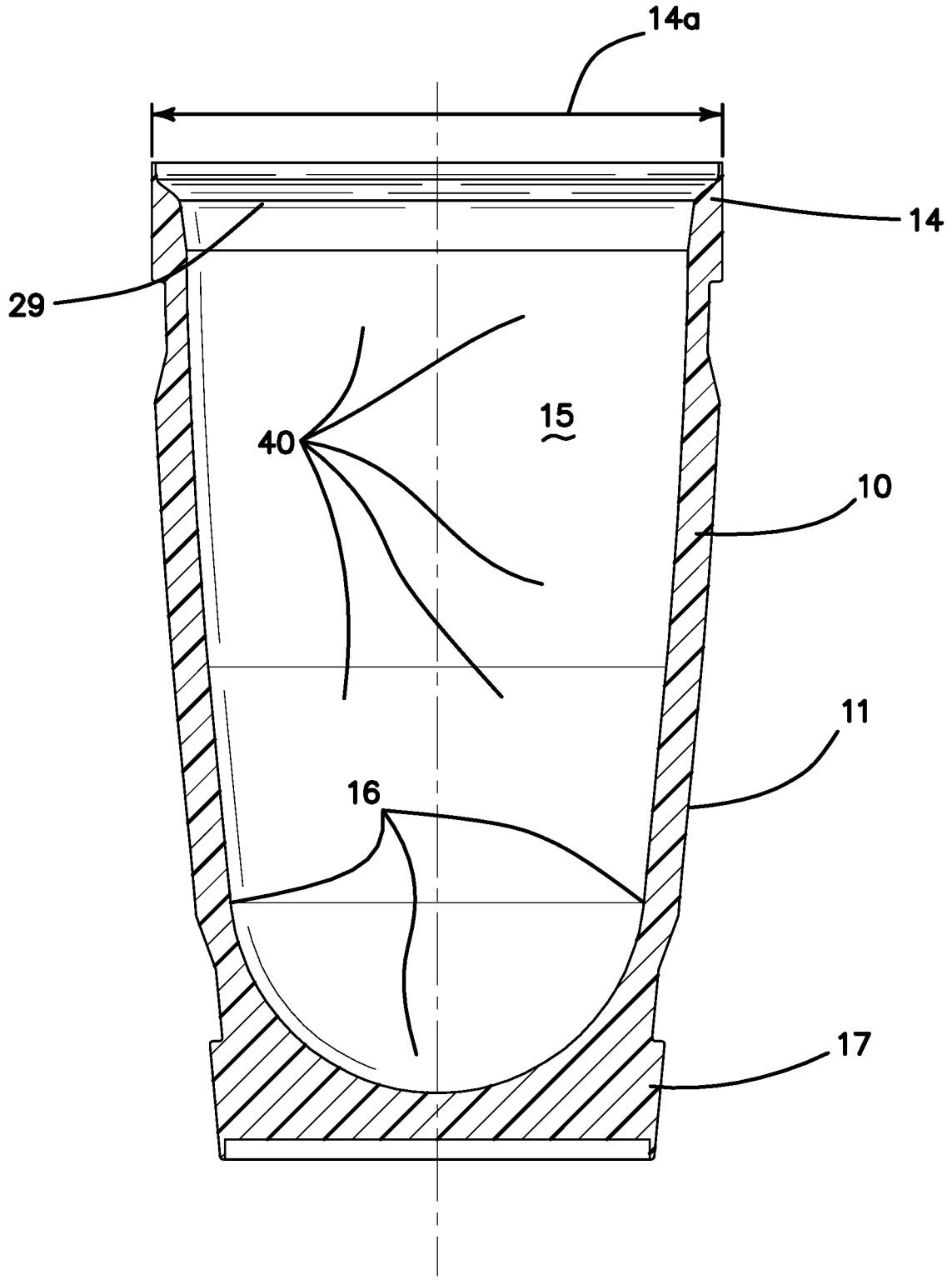
FIG. 4 depicts a side cross-section view of an exemplary receptacle of FIGS. 1-3.

FIG. 4 shows a side cross-section view of the receptacle 10. The receptacle 10 may be substantially frustoconical in shape about a central axis (A), with a wider open end 14 and a narrower closed end 17. The wider open end 14 of the receptacle 10 has a central opening 14*a* configured to receive a fluids poured into the receptacle 10. The wider open end 14, central opening 14*a*, and narrower closed end 17 allow for ease of cleaning, as the user may readily insert a hand, sponge, brush, or other cleaning utensil into the receptacle 10 and reach all areas within with ease without the need to reach into any crevice, crack, fold, ledge or other protected region where food, debris or other matter might be left or caught. It can now be appreciated that the interior shape of receptacle 10 is entirely smooth and without lines, cracks, crevices or any other interrupting interior surface feature that would invite retention of any residue, bacteria, or fungus. It is to be understood that the receptacle 10 can be of any suitable size or exterior shape, including cylindrical, rectangular, or any other suitable shape.

Figure 5:
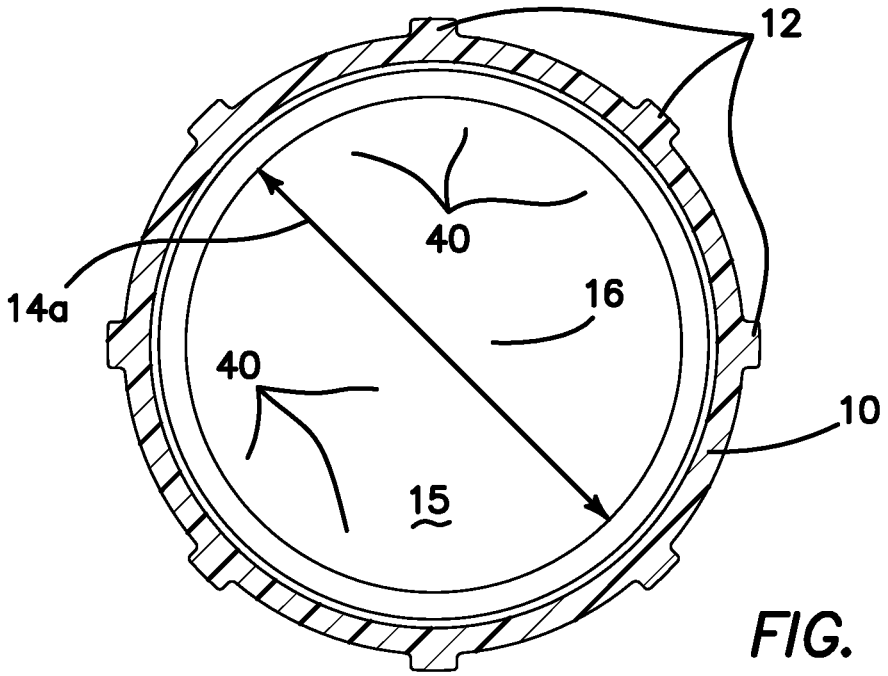
FIG. 5 illustrates a top view of an exemplary lower base of the receptacle of FIG. 1. There is no lid shown from this view.

The receptacle 10 also has an inner surface 15 with a lower base portion 16 on the inside of the narrower closed end 17, opposite the central opening 14*a*. The inner surface 15 and lower interior base portion 16 are constructed to have a curvature, with no edges, corners, or distinctly angled connections between segments. The interior lower base portion 16 may be completely rounded as shown in FIGS. 4-5. Providing an inner surface 15 and lower base portion 16 in this manner prevents accumulation of fluid and other particles in these areas during and between uses and also enables the user to clean these areas thoroughly and with ease.

Figure 6:
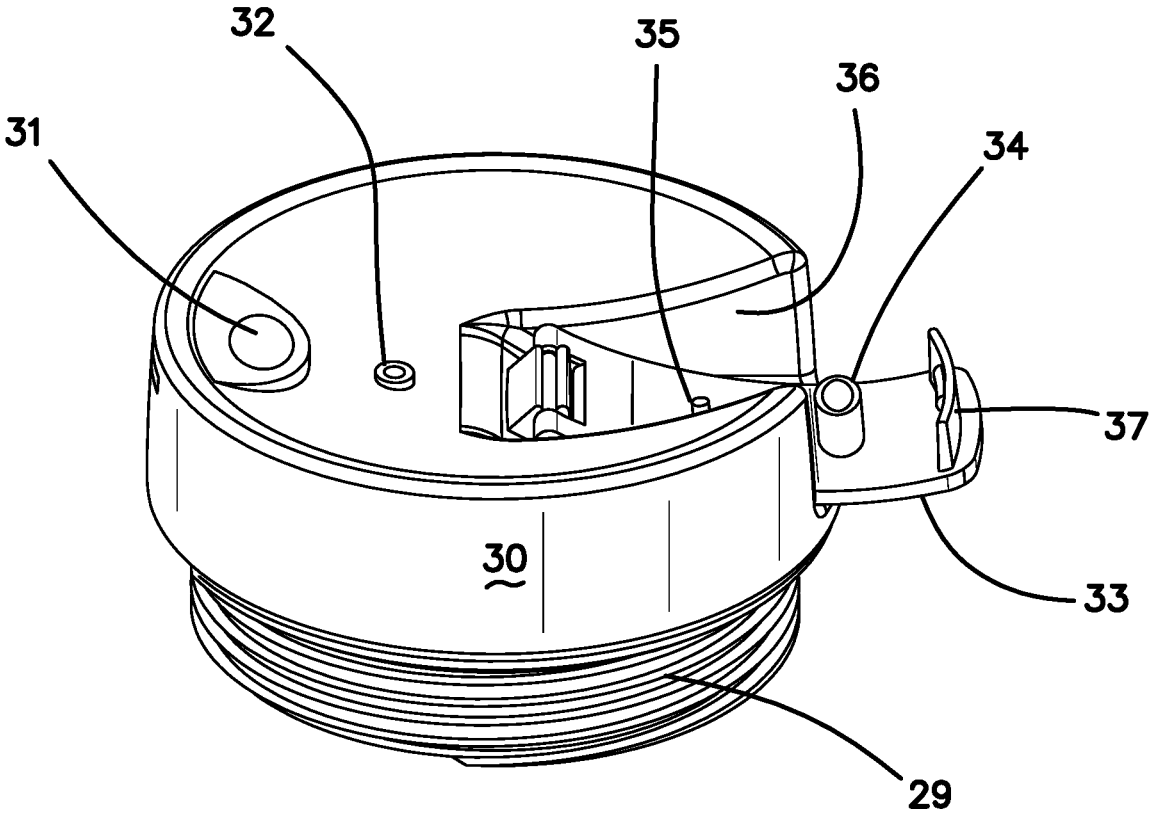
FIG. 6 shows a side cross-section view of an exemplary matched lid of FIG. 1 in the open position.

FIG. 6 depicts an upper perspective view for an exemplary matching lid 30. The lid 30 may be reversibly fastened onto the receptacle 10 by use of mated threads 29 or any other acceptable fastening mechanism. The lid 30 may be a single piece used as a removable covering or may have a mechanism or pivoted stopper flap 33 for reversibly sealing the lid to allow the user to access the fluid contained within the receptacle 10 without removal of the lid 30.

Lid 30 may be constructed as a completely solid piece without any internal compartments. Alternatively, lid 30 may be constructed to have at least one chamber 39 within the lid 30. The chamber 39 may be hollow or may be filled with any material, which may or may not affect the thermal insulation abilities of the lid 30.

The lid 30 may also have a drinking channel 31 that goes through the entirety of the lid allowing fluid to travel from the inside of the assembly 100 to the outside without having to remove the lid 30 as best seen in FIG. 6. There may also be an additional air hole 32 provided in the lid 30 to allow air to enter into the assembly 100 as the user drinks from the assembly 100. In an embodiment where the lid 30 has a chamber 39, both the drinking channel 31 and air hole 32 may be completely bounded as seen from a top plan view, preventing any transfer of material into the chamber 39 during use of the assembly 100.

Figure 7:
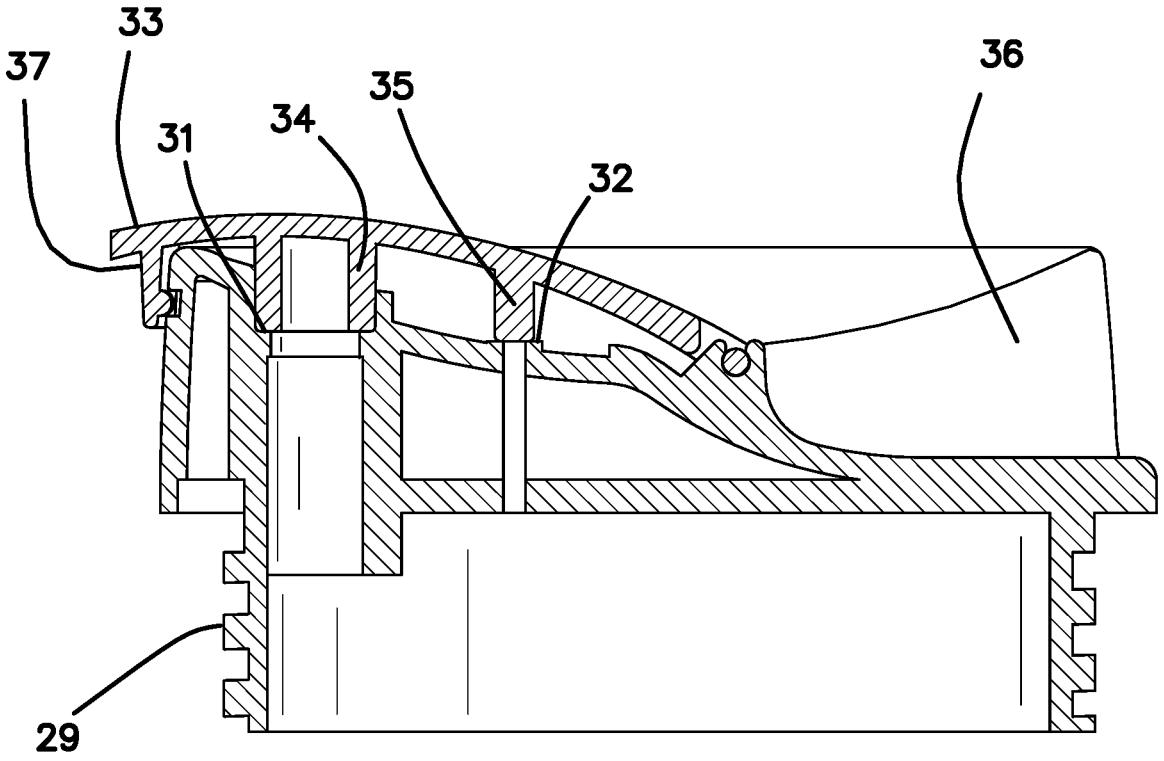
FIG. 7 depicts an upper perspective view of an exemplary matched lid of FIG. 1 in the closed position.
Figure 8:
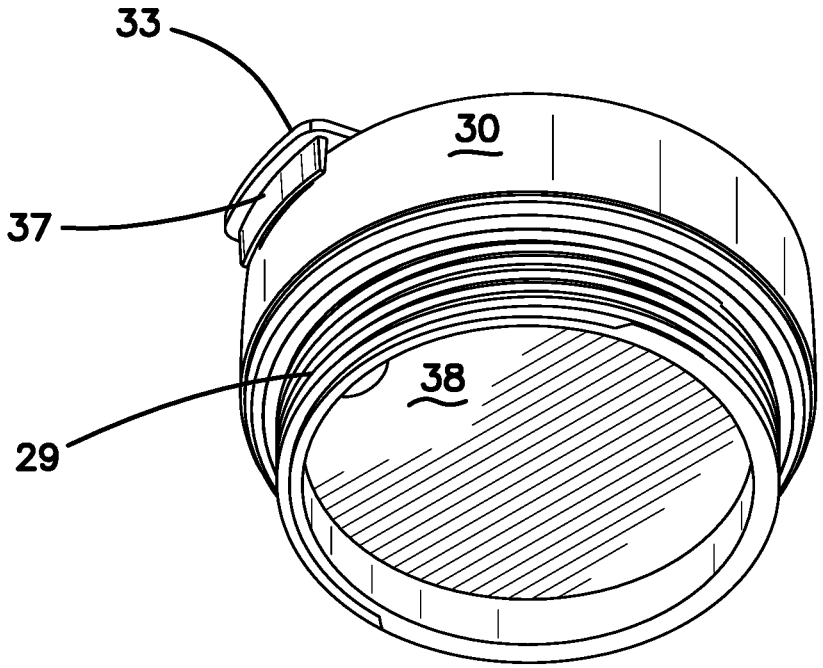
FIG. 8 depicts a lower perspective view of an embodiment of the matched lid of FIG. 1 with a conventional underside.

Lid flap 33 is pivotally attached to the lid 30 and can pivot between an open position shown in FIG. 6 and a closed position shown in FIG. 7. The lid flap 33 may have a first projection 34 provided for sealing the drinking channel 31 and a second projection 35 provided for sealing the air hole 32, as shown in FIGS. 6-7.

In the open position as depicted in FIG. 6, the lid flap 33 is pivoted away from the drinking channel 31 and air hole 32 and is positioned within a recess 36 and may be secured by friction fit or snap fit. The lid flap 33 may be attached to the center of lid 33. Alternatively, the lid flap 33 may be attached to the lid 30 at a distance opposite the drinking channel 31 and air hole 32. The recess 36 may also be of various depths allowing the lid flap 33 to rest above, on, or below the plane created by the surface of the lid 30 as seen from a top plan view. By providing such features, undesirable contact between the first projection 34 and a user's nose that occurs during use of the assembly 100 can be prevented.

In the closed position as depicted in FIG. 7, the first projection 34 is positioned within the drinking channel and secured by friction fit or snap fit. The second projection 35 is similarly positioned within the air hole and secured by friction fit or snap fit. The lid flap 33 may additionally have a lift tab 37 for increased leverage.

Figure 9:
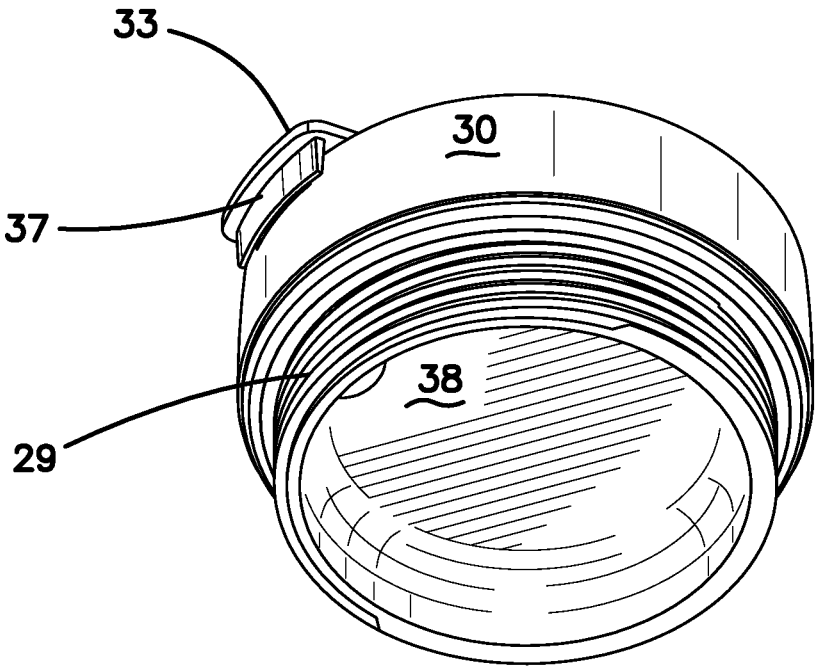
FIG. 9 illustrates a lower perspective view of another embodiment of the matched lid of FIG. 1 having a rounded underside.

The lid 30 may further have an interior surface 38 constructed to have substantial curvature, as to have no edges, corners, or distinctly angled connections between segments, as shown in FIG. 9. The interior surface 38 may be completely rounded or smooth. Providing an interior surface 15 in this manner prevents accumulation of fluid and other particles in these areas during and between uses and also enables the user to clean these areas thoroughly and with ease.

Furthermore, the inner surface 15 and lower base portion 16 of the receptacle and the interior surface 38 of the lid 30 may both be coated with a coating 40 with hydrophobic, oleophobic, and antimicrobial properties. The coating may be a nano-ceramic based coating, an $SiO_2$ based nano-coating, or an alcohol based coating, such as an isopropanol coating combine with an organosilane derivative. The antimicrobial properties may come from an antimicrobial additive, such as a silver glass antimicrobial powder. Application of such the coating 40 to such surfaces allows for increased hygienic conditions and ease of cleaning.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

What is claimed:

1. An easily cleanable drinking assembly, comprising:

a receptacle having an exterior surface with at least one raised ridge, an inner surface, a closed end and an open end;

where the inner surface of the receptacle has a curved lower base without any edge;

a removable grip sleeve with at least one slot defined therethrough matching the at least one raised ridge on the exterior surface of the receptacle;

an attachable and detachable lid having an inner surface;

where an inner surface of the drinking assembly is comprised of the inner surfaces of the receptacle and the lid, wherein the inner surface of the lid is curved without any edge such that there are no distinctly angled connections between segments when viewed from both horizontal and vertical perspectives; and a single coating that has hydrophobic, oleophobic and antimicrobial properties on the inner surface of the receptacle.

2. The drinking assembly according to claim 1, wherein the single coating that has hydrophobic, oleophobic and antimicrobial properties is also on an inner surface of the lid.

3. The drinking assembly according to claim 1, wherein the inner surface of the drinking assembly is without any edge when the lid is attached to the receptacle.

4. The drinking assembly according to claim 1, wherein the receptacle has a diameter that decreases from the open end of the receptacle toward the closed end of the receptacle.

5. The drinking assembly according to claim 1, wherein the inner surface of the receptacle defines a conical shape with a smooth rounded apex.

6. An easily cleanable drinking assembly, comprising:

a receptacle having an exterior surface with at least one raised ridge, a closed end, an open end and an inner surface of the receptacle with a completely rounded lower base portion of the inner surface;

a removable grip sleeve having at least one slot defined therethrough matching the at least one raised ridge on the exterior surface of the receptacle;

a removable lid; and a hydrophobic, oleophobic and antimicrobial coating on the inner surface of the receptacle and an interior surface of the lid;

wherein the removable lid has an interior surface and wherein the interior surface of the lid is curved without any edge such that there are no distinctly angled connections between segments when viewed from both horizontal and vertical perspectives.

7. The drinking assembly according to claim 6, wherein the open end of the receptacle has a diameter that decreases toward the closed end of the receptacle.

8. The drinking assembly according to claim 7, wherein the receptacle has a frustoconical exterior.

9. The drinking assembly recited in claim 8, wherein the inner surface of the receptacle has a diameter at the open end of the receptacle that decreases toward an apex of the completely rounded lower base.

10. The drinking assembly according to claim 9, wherein the inner surface of the receptacle has a cone shape with a rounded apex.

11. The drinking assembly according to claim 6, wherein an inner surface of the drinking assembly is comprised of the inner surface of the receptacle and the interior surface of the lid and the inner surface of the drinking assembly is without any edge when the lid is attached to the receptacle.

12. An easily cleanable drinking assembly, comprising:

a receptacle having a closed end, an open end and an exterior surface, wherein the exterior surface has at least one raised ridge, where the receptacle has an inner surface, wherein the inner surface has a completely rounded lower base, and is coated with a single hydrophobic, oleophobic and antimicrobial coating;

a removable lid, where an interior surface of the lid is completely rounded, and has a second single hydrophobic, oleophobic and antimicrobial coating disposed on the interior surface of the lid, the lid has a pivoted flap affixed on a top of the lid, a recess is provided on a top surface of the lid, wherein the recess is positioned along a pivoting arc of the pivoted flap, the lid has at least one chamber positioned between the top surface of the lid and the interior surface of the lid, the lid has a drinking channel and air hole, wherein the drinking channel and air hole are bounded as seen from a top plan view, and an inner surface of the drinking assembly is comprised of the inner surface of the receptacle and the interior surface of the lid and the inner surface of the drinking assembly is without any edge when the lid is attached to the receptacle; and a removable grip sleeve with at least one slot defined therethrough to match the at least one raised ridge on the exterior surface of the receptacle.

13. The drinking assembly recited in claim 12, wherein the receptacle has a cylindrical exterior shape.

14. The drinking assembly recited in claim 12, wherein the inner surface of the receptacle has a diameter at the open end of the receptacle that decreases toward the completely rounded lower base of the inner surface.

* * * * *